United States Patent [19]

Noren

[11] 4,228,813

[45] Oct. 21, 1980

[54] LOW TEMPERATURE CONVEYOR, RACK-TYPE DISHWASHER

[76] Inventor: Tore H. Noren, 3200 Lakeville Hwy., Petaluma, Calif. 94952

[21] Appl. No.: 26,016

[22] Filed: Apr. 2, 1979

[51] Int. Cl.[3] ..... B08B 3/02

[52] U.S. Cl. ..... 134/47; 134/60; 134/104

[58] Field of Search ..... 134/47, 60, 46, 104

[56] References Cited

U.S. PATENT DOCUMENTS

| | | | |
|---|---|---|---|
| 2,619,097 | 11/1952 | Von Brömssen | 134/60 X |
| 2,949,120 | 8/1960 | Federighi et al. | 134/60 X |
| 3,949,772 | 4/1976 | Hartmann | 134/104 X |
| 4,094,329 | 6/1978 | Evans | 134/60 X |
| 4,134,413 | 1/1979 | Noren | 134/47 |

*Primary Examiner*—Robert L. Bleutge

*Attorney, Agent, or Firm*—Alvin E. Hendricson; William R. Piper

[57] ABSTRACT

A low temperature conveyor rack-type dishwasher in which the ware-carrying racks are step-wise advanced through a scrapper module, a ware washing module and a rinsing and sanitizing module. The rinsing module has two compartments. In the first compartment fresh hot water at 140° F., is sprayed onto the ware to wash off the detergent from the wash water. In the second rinsing compartment a predetermined volume of sodium hypochlorite is mixed with fresh hot water at 140° F., for rinsing and sanitizing the ware. A tank is provided under each rinse compartment and the overflow from the second compartment is fed into the tank of the first compartment and the overflow from this tank is conveyed back to the scrapper to remove food soil from the screens in that module and to add fresh hot water to the tank underlying the scrapper.

3 Claims, 9 Drawing Figures

FIG-5-
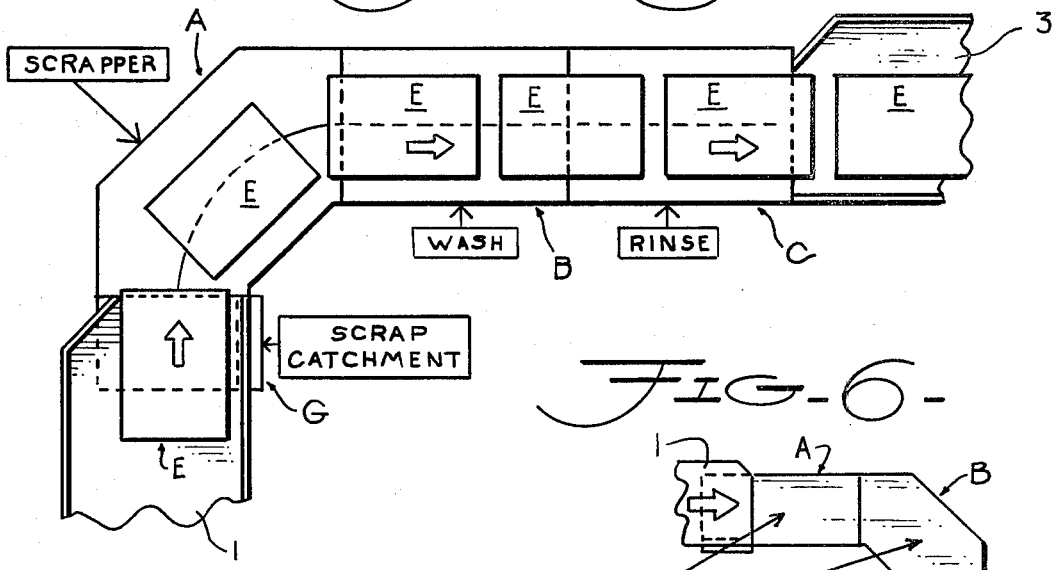
FIG-6-
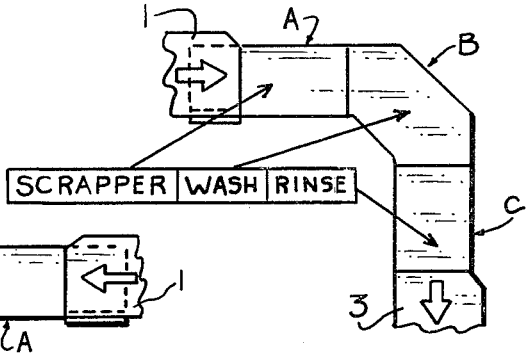
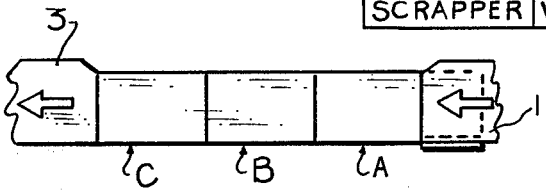
FIG-7-
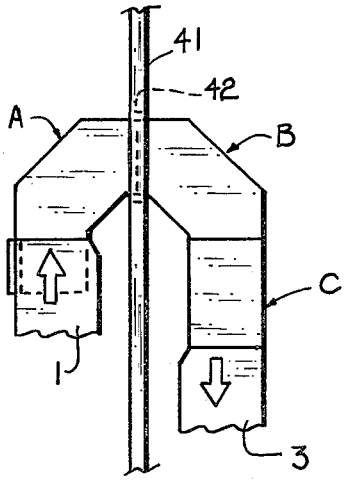
FIG-9-
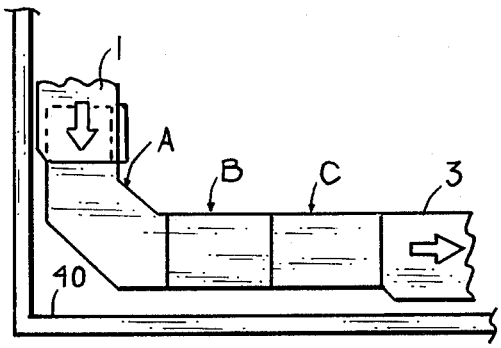
FIG-8-

LOW TEMPERATURE CONVEYOR, RACK-TYPE DISHWASHER

SUMMARY OF THE INVENTION

An object of my invention is to provide a low temperature conveyor rack-type dishwasher which has a novel two compartment ware rinsing module making use of low temperature fresh rinse water in the first compartment for removing the detergent wash water from the ware and also making use of low temperature fresh rinse water in the first compartment for removing the detergent wash water from the ware and also making use of low temperature fresh rinse water in the second compartment and mixing this water with chlorine for sanitizing the ware before the rack moves out from the rinsing module.

DESCRIPTION OF THE DRAWINGS

FIGS. 5 to 9 inclusive, show schematic layouts for interconnecting various modules together, some of these modules being arcuate in shape.

DESCRIPTION OF THE PREFERRED EMBODIMENT

Figure 1:
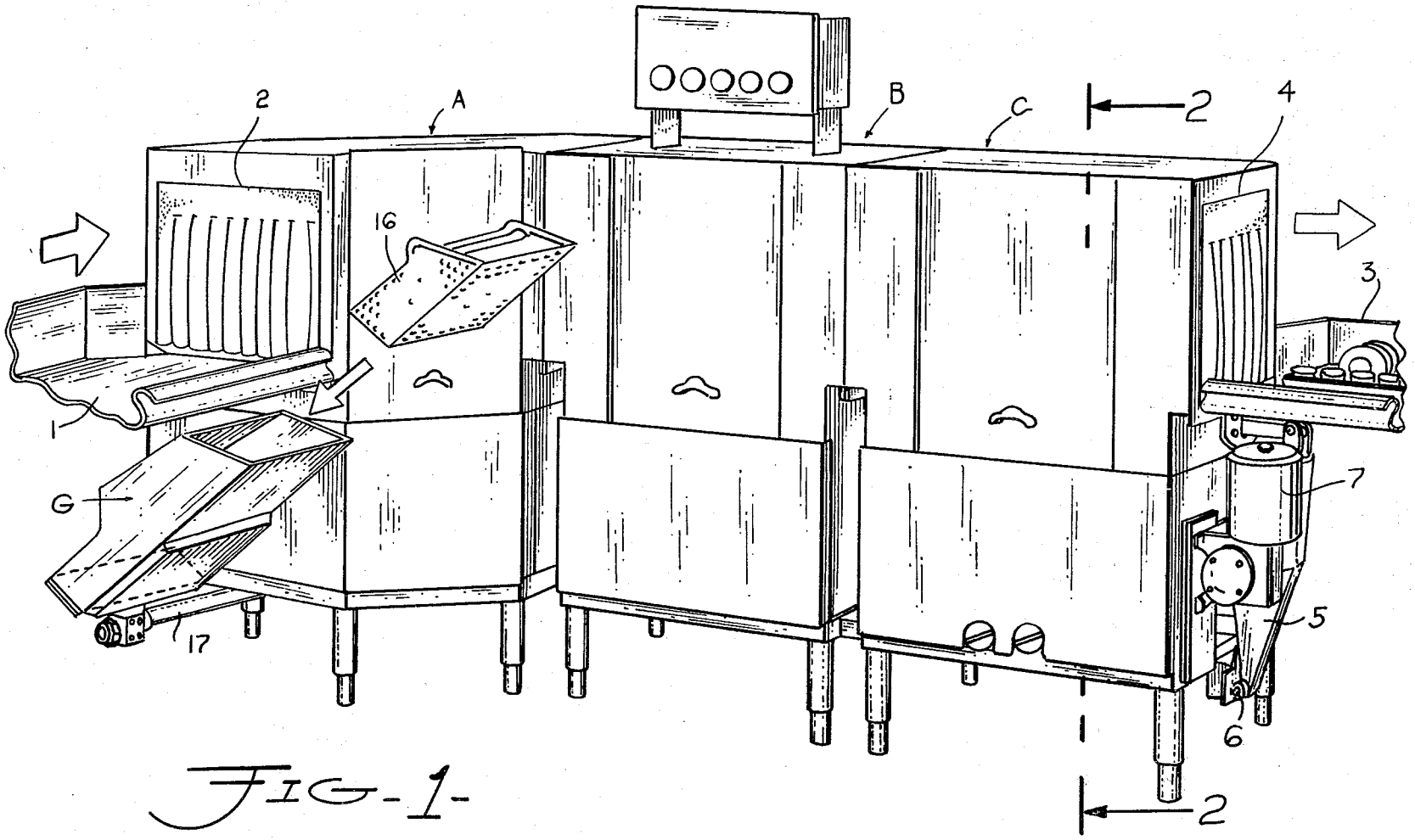
FIG. 1 is a perspective view of the dishwasher.

In carrying out my invention I show in FIG. 1, a scrapper module A, a ware washing module B, and a two compartment ware rinsing and sanitizing module C. The module A, is arcuate in shape and it is possible to have the other two modules also arcuate in shape if desired. I disclose arcuate-shaped racktype modulars in my two U.S. Pat. No. 3,949,770, issued Apr. 13, 1976, and No. 3,985,226, issued Oct. 12, 1976. A rack feeding table 1 is connected to the scrapper A, and the operator can move the rack through the curtained entrance opening 2 and into the interior of the scrapper. A rack-receiving table 3 is connected to the exit end of the ware rinsing module C and receives the racks passing through the curtained outlet opening 4.

Figure 3:
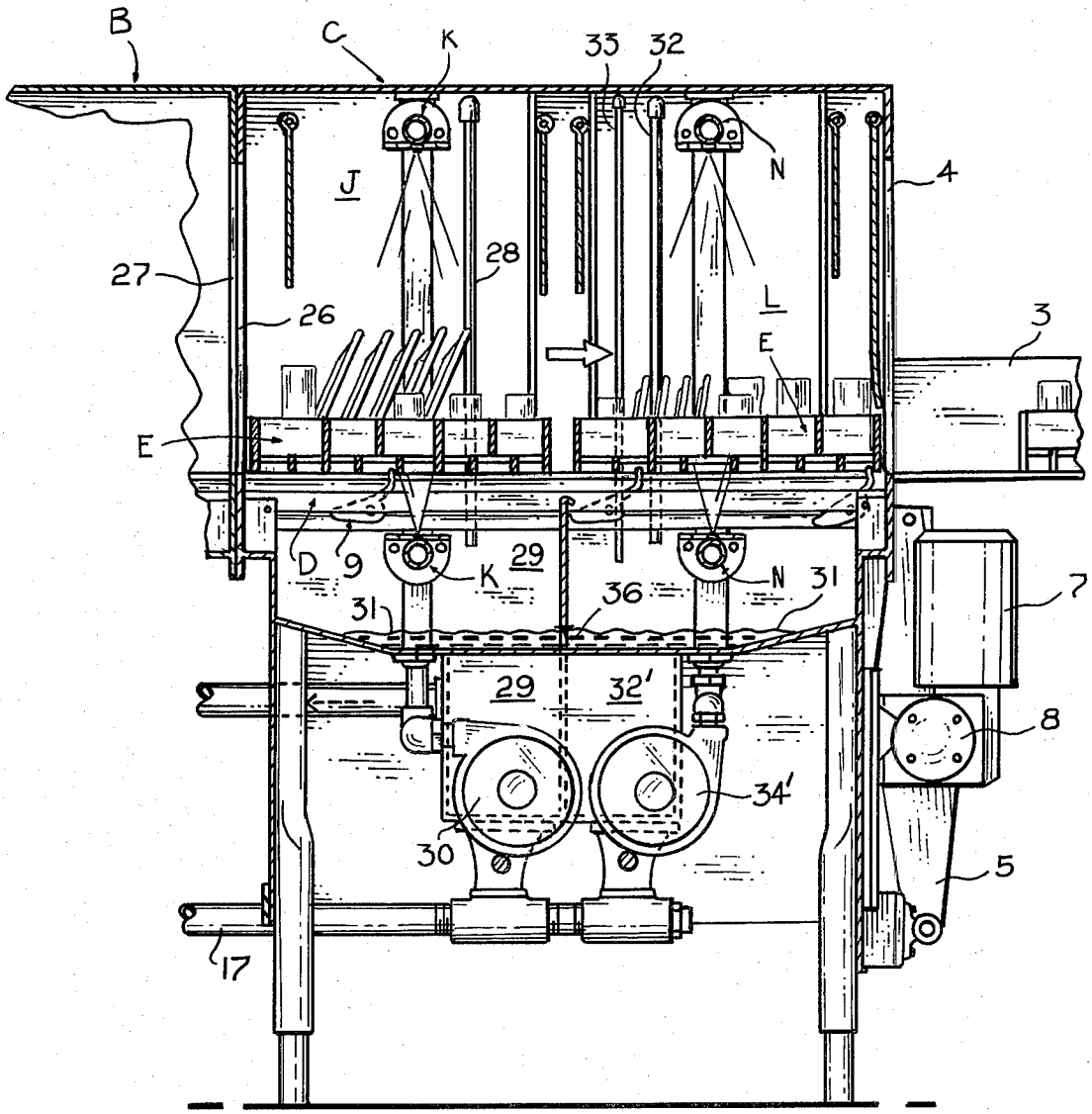
FIG. 3 is a longitudinal vertical section through the ware rinsing module to show the two compartments and it is taken along the line 3—3 of FIG. 2.
Figure 4:
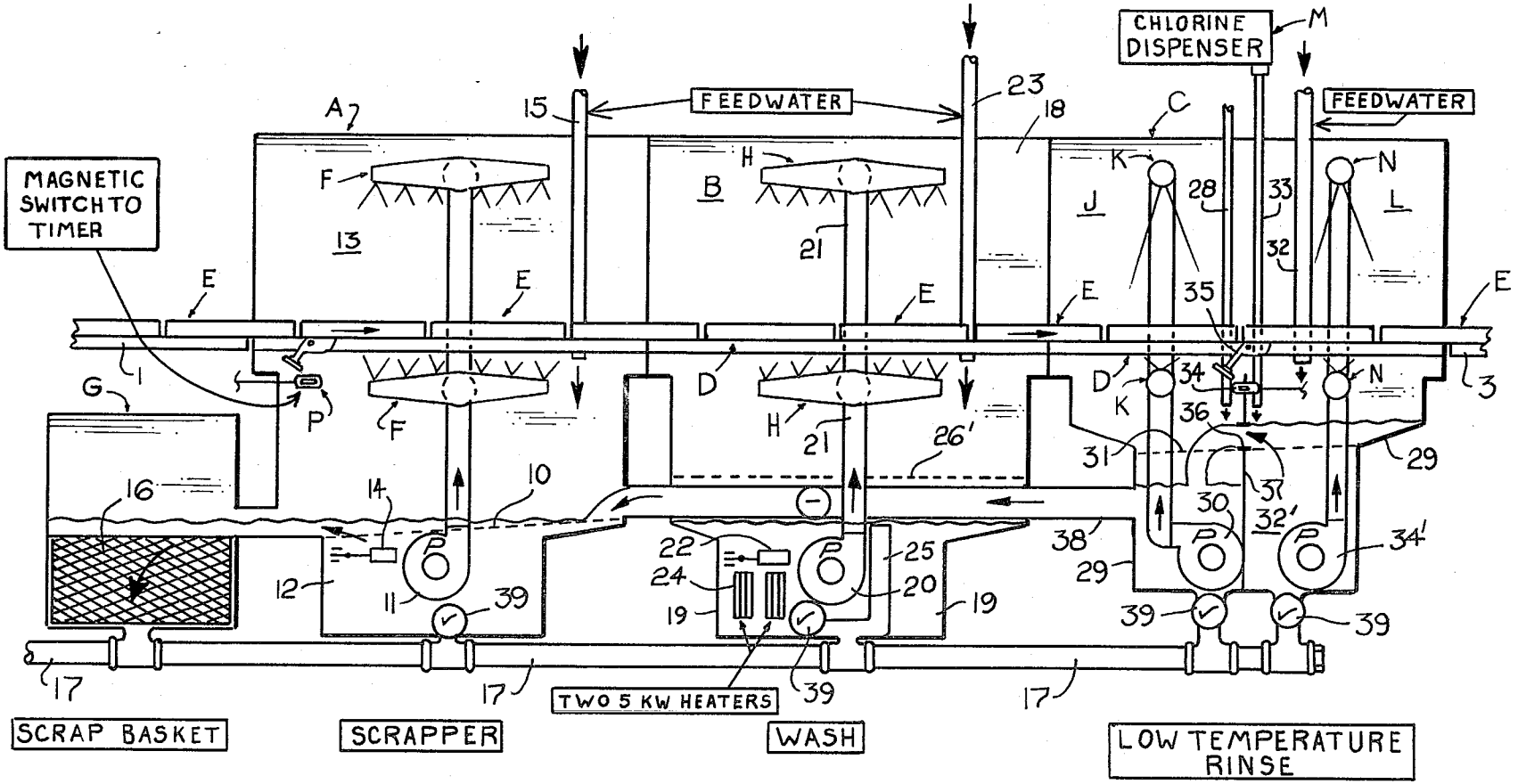
FIG. 4 is a schematic showing of the entire dishwasher showing the modules consisting of the scrapper, ware washer, and the two compartment rinsing and sanitizing module.

In FIG. 4, a schematic view of the entire dishwasher is shown while in FIG. 3, a more detailed sectional view of the two compartment rinsing and sanitizing module C, is illustrated. A pawl carrying bar D is reciprocated by a lever 5, pivoted at 6, and a motor 7 actuates a gear mechanism 8, including a crank, not shown for oscillating the lever which in turn reciprocates the rack moving bar D. The particular type of mechanism for reciprocating the pawl carrying bar D, is disclosed in the George J. Federighi and Tore H. Noren U.S. Pat. No. 2,689,639, issued Sept. 21, 1954 of which I was one of the joint inventors. The disclosure of this patent is made a part of the mechanism that reciprocates the pawl carrying bar D for stepwise advancing the ware-carrying racks through the scrapper, ware washer and the two compartment rinsing and sanitizing module C. The bar D pivotally carries a plurality of spaced apart pawls 9, that successively engage with the ware-carrying racks E to stepwise advance the racks from left to right in FIG. 3, as the bar is reciprocated. The bar reciprocating mechanism 5–8 will automatically stop actuating the bar D, should the racks E, or bar become jammed. This mechanism is shown in detail in U.S. Pat. No. 2,689,639, and is made a part of this specification.

I provide a reciprocating bar D, for each of the modules A, B and C, and when these modules are bolted together to make up the complete dishwasher, the bar D of each module is adjustably connected to the bar in the adjacent unit. My U.S. Pat. No. 3,949,770 and No. 3,985,226 in FIG. 9 of each patent illustrates how the adjustable connection is made between adjacent bars D, and that disclosure is made a part of the present invention. Referring to the schematic showing of the entire dishwasher in FIG. 4, the interconnected bars D, of the several modulars are shown as a single bar D, which is reciprocated by the mechanism shown at 5–8 in FIG. 3. The rack pawls 9 are not shown in FIG. 4.

The scrapper module A removes the food soil from the ware carried by the racks and this food soil is dropped upon an inclined screen shown by dotted lines 10 in the schematic view of FIG. 4. The module A has upper and lower spray arms F, and a two horse power motor driven pump 11 takes hot water from the tank 12, underlying the scrapper compartment 13, and forces this hot water through the two spray arms at about 300 gallons per minute to remove the food soil from the ware in the racks E. A float valve 14 controls the level of hot water in the tank 12 and when the water level drops below a predetermined level, the float valve actuates a mechanism for opening a valve, not shown, for permitting fresh hot water at 140° F., to flow through an inlet pipe 15 that delivers the water to the tank 12. Any excess water in the tank will flow into a scrap catchment, shown schematically at G, in FIG. 4. The food soil is retained in a removable perforated basket 16 which may be removed from time to time as shown in FIG. 1 so as to clean out the food soil therefrom. The waste water will flow from the basket and scrap attachment into a drain pipe 17 that connects with a sewer.

The scrapper A forms no part of my present invention except in so far as it cooperates with the entire dishwasher and forms an operative part thereof. The scrapper A is shown and described in detail in my two U.S. Pat. No. 3,949,770 and No. 3,985,226, and forms a part of the present disclosure. In fact, the scrapper A, in FIG. 1, is shown arcuate in shape and has an arcuate-shaped reciprocating bar D. The two patents just mentioned, likewise show an arcuate-shaped scrapper and therefore the details of the scrapper shown in these patents becomes a part of the present disclosure.

The ware washing module B, is bolted to the scrapper module A, and the adjacent sides of the two modules have registering openings that permit the racks in the scrapper to be moved into the washing module. Ths reciprocating arcuate bar D, in the scrapper is adjustably connected to the reciprocating bar D, in the washing module. My two U.S. Pat. No. 3,949,770 and No. 3,985,226, illustrate the washer module B in detail and the disclosure of these two patents becomes a part of the present invention. The washing module B, has a wash compartment 18 overlying a wash water receiving tank 19, see FIG. 4. A motor driven two horsepower pump 20, receives wash water from the tank 19 and forces this water through pipes 21 into upper and lower wash spray arms H, for washing the ware, the water being returned to the tank 19 and being used again.

A float valve 22 is shown diagrammatically in FIG. 4 and is placed in the wash tank 19 for actuating mechanism, not shown, for delivering fresh hot water at 140° F., through a pipe 23 into the wash tank. The hot wash water in the tank 19 is maintained at a temperature of 140° F., by two 5 KW hot water heaters 24 that are thermostatically controlled by a means, not shown. An overflow drain pipe 25, is positioned in the wash tank 19 and is in communication with the drain pipe 17 for conveying excess water to the sewer. A screen, shown by the dotted lines 26' in FIG. 4, is positioned in the wash module B, and is positioned above the water level in the wash tank 19. The racks E, are stepwise advanced through the wash module B, so that the ware is effectively washed. A liquid detergent is mixed in proper proportion with the fresh hot water at 140° F., that enters the wash tank inlet pipe 23. The pump 20 keeps recirculating the hot detergent water through the spray arms H, in the wash module while the racks E are moved therethrough.

Figure 2:
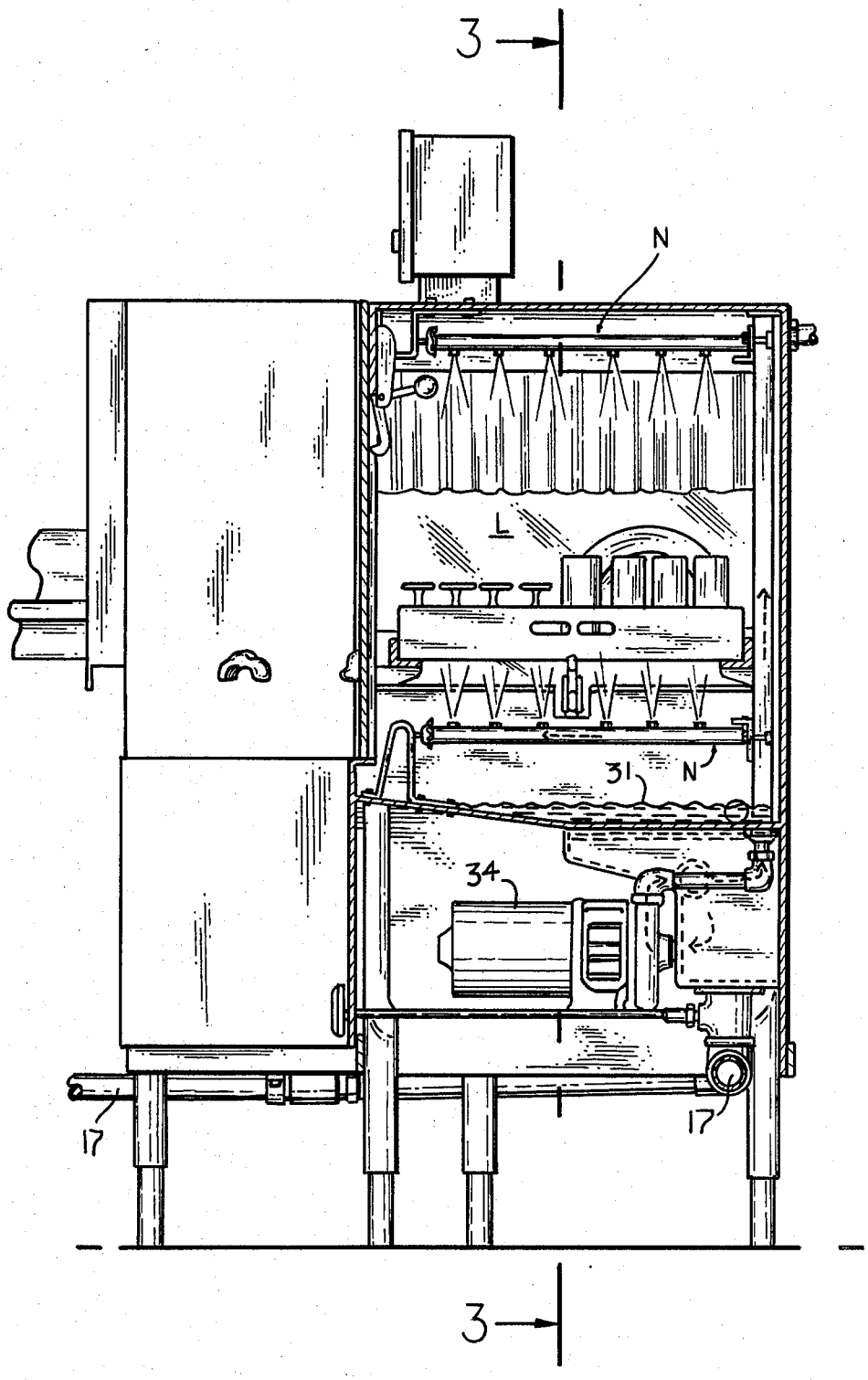
FIG. 2 is an enlarged transverse vertical section through the ware rinsing module and is taken along the line 2—2 of FIG. 1.

The double compartment ware rinsing module C, is the novel feature of the present invention. FIGS. 2 and 3 illustrate in detail the structure of the module and FIG. 3 shows an entrance opening 26 in the module that registers with an exit opening 27 in the module B. The reciprocating pawl carrying bar D, in the module C, is adjustably connected to the bar D, in the module B. The pawls 9 on the bar will engage the rack E only when the bar is moving to the right in FIG. 3. This will cause the ware carrying racks to be stepwise moved through the module C, as the bar is reciprocated by the mechanism 5–8.

The module C has a left-hand compartment J, in FIG. 3 in which the washed rack of ware is first received. The compartment J has a fresh hot water supply pipe 28 for delivering hot water at 140 ° F., to initially the tank 29 that underlies the compartment. A pump 30 removes hot water from the tank 30 and forces this water through upper and lower spray arms K for rinsing the ware in the rack E and removing any detergent. The compartment J is called the primary rinse. The water level in the primary tank 29 is generally indicated by the dotted lines 31 in FIG. 4.

The pawl carrying bar D moves the rinsed ware from the primary rinse compartment J, into a secondary rinse compartment L in which fresh hot water at 140° F., and chlorine is sprayed against the ware for sanitizing the ware. The fresh hot water is delivered into a tank 32' that underlies the compartment L, and I show a feedwater pipe 32 for this purpose. A chlorine dispenser M, delivers the proper amount of chlorine through a pipe 33 into the tank 32' to mix with the fresh water at 140° F. in the tank. A pump 34' removes the hot sanitized water from the tank 32 and forces this water through upper and lower spray arms N for sanitizing the ware in the final rinse compartment L. The rinsed and sanitized ware is then delivered to the rack receiving table 3. A magnetic switch 34 is placed in the second rinse compartment L, see FIG. 4, and starts the flow of chlorine and feedwater and operation of the pump 34' when a rack E is moving through the compartment and swings a magnet 35 past the switch to close an electric circuit to the pump. The hot water pipe 32 and the chlorine pipe 33 have valves, not shown, that control the flow of hot water and chlorine into the tank 32' in a predetermined manner.

The hot rinse water in the tank 32 will receive hot water from the pipe 32 during the secondary rinsing in compartment L, and the excess hot water will pass through an overflow opening 36, see FIG. 4, in the partition 37 that separates the tank 29 from the tank 32' to provide the water for the primary rinse in compartment. The overflow of hot water from the tank 29 will enter a pipe 38 that will convey the hot water to the tank A where it will flow over the inclined screen 10 in the tank to wash the debris on the screen into the scrap catchment G. My U.S. Pat. No. 3,949,770, issued Apr. 13, 1976, on an Arcuate-Shaped Modulars for a Commercial Dishwashing Machine shows the inclined screen in FIG. 11B of that patent and further shows the hot water conveying pipe delivering the water onto the screen.

The tanks 12, 19, 29 and 32' have drain valves 39 which may be opened during non-use of the system for draining water from the tanks into the drain pipe 17 that connects with a sewer. The hot water at 140° F., flows through the feedwater pipe 32 into the secondary rinse each time a rack E passes therethrough. The tank 32' in the secondary rinse then becomes overfull and the hot water will overflow into the primary rinse tank 29. This will change the water in both of these tanks 29 and 32' to keep it fresh. The hot overflow water from the tank 29 will enter the bypass pipe 38 and flow over the inclined screen 10 in the tank 12 to move any debris on the screen into the scrap catchment G while the hot water will drain through the screen to replenish the water in the wash tank 12 and to raise its temperature. If the scrapper module A, is not used, the water in the bypass pipe 38 would be delivered to the sewer.

The dishwasher shown in FIG. 4 is equipped with an energy saving automatic shut-off device. When a rack E is moved into the scrapper module A, it will actuate an adjustable magnetic switch timer in addition to starting the pumps and the pawl carrying bars D. The adjustable timer will turn the machine off at a pre-set time interval if another rack E is not inserted into the machine. As soon as another rack is entered into the machine, the timer will be reset. The timer P does not effect the tank heat, since it only controls the pumps and the pawl-carrying bars D.

In FIGS. 5 to 9 inclusive, I show different arrangements of the modules A, B and C shown in FIG. 1. Anyone of these three modules may be either in a 90° arc or a straight module. FIG. 5 shows the same general arrangement of the modules A, B and C, as are shown in FIG. 1, while in FIG. 6 the washing module B, is shown forming a 90° arc. In FIG. 7 all three modules A, B, and C form a straight line. FIG. 8 illustrates how the three modules A, B, and C can be arranged to occupy the corner 40 of a room and thus use space that would normally be lost. In FIG. 9 the arrangement of the three modules show how the rack feeding table 1 for the soiled dishes can be positioned on one side of a partition 41 while the rack receiving table 3 is on the other side of the same partition. An opening 42 in the partition permits the two modules A and B to be joined and extend through the opening. Such an arrangement permits the soiled dishes to enter the dishwasher on the unsanitary side of the partition 41 while the rinsed and sanitized dishes are removed from the table 3 on the sanitary side of the partition.

I claim:

1. In a dishwashing machine, a two compartment ware rinsing and sterilizing module wherein the first compartment is for rinsing the wash water and detergent from the ware and the second compartment is for secondary rinsing with a sterilizing agent added for permitting hot water 140° F., to be used to sterilize the ware;

(a) means for moving the ware successively through the first and second compartments;

(b) a first water receiving tank underlying the first compartment for receiving hot rinse water therefrom;

(c) a first water circulating means in the first tank for removing water therefrom and spraying it onto the ware in the first compartment for removing the washwater and detergent from the ware;

(d) means for feeding fresh hot water at 140° F. and for metering a sterilizing agent into a second tank underlying said second compartment;

(e) a second water and sterilizing circulating means in the second tank for drawing sterilizing water therefrom and spraying it onto the ware in the second compartment for rinsing and sterilizing the ware; and (f) means for receiving overflow water from the second tank and delivering it to said first tank for maintaining the level of water in said first tank.

2. The combination as set forth in claim 1: and in which (a) means is actuated by the ware moving into the second compartment for turning on the fresh hot water and sterilizing agent for delivering both to the second tank while the ware is in the second compartment.

3. The combination as set forth in claim 1: and in which (a) the dishwashing machine includes a scrapper module and a ware washing module through which the ware passes before entering the first rinse compartment, the scrapper module having an inclined screen over a third tank;

(b) means for by-passing the overflow water from said first tank, past the washing module and delivering this water onto the inclined screen for washing debris from the screen; and (c) a scrap catchment for receiving the debris washed from the screen, the hot water passing through the screen and into the third tank for replenishing the water therein and raising its temperature.

* * * * *